US005221040A

United States Patent [19]

Sorenson

[11] Patent Number: 5,221,040

[45] Date of Patent: Jun. 22, 1993

[54] BUCKLE-PROOF CLAMSHELL CARTON

[75] Inventor: John F. Sorenson, Naperville, Ill.

[73] Assignee: Perseco Division of the Havi Group LP, Oak Brook, Ill.

[21] Appl. No.: 898,026

[22] Filed: Jun. 12, 1992

[51] Int. Cl.[5] ..... B65D 5/66

[52] U.S. Cl. ..... 229/114; 229/146; 229/148; 229/906; 229/920

[58] Field of Search ..... 229/114, 146, 148, 149, 229/150, 902, 906, 920; 220/4.23, 4.24, 4.25

[56] References Cited

U.S. PATENT DOCUMENTS

| | | | |
|---|---|---|---|
| 329,134 | 10/1885 | Brotz | 229/146 |
| 708,288 | 9/1902 | Winslow | 229/114 |
| 1,329,531 | 2/1920 | Kitt | 229/120 |
| 1,771,760 | 7/1930 | MacLellan | 229/152 |
| 1,839,752 | 1/1932 | Fogg | 229/115 |
| 2,247,870 | 7/1941 | Chalmers | 229/146 |
| 2,468,543 | 4/1949 | Chalmers | 229/920 |
| 2,544,565 | 3/1951 | Phillips . | |
| 3,163,344 | 12/1964 | Tunick | 229/906 |
| 3,190,535 | 6/1965 | Nute | 229/126 |
| 3,330,467 | 7/1967 | Johnson | 229/126 |
| 3,343,660 | 9/1967 | Bailey | 229/114 |
| 4,230,261 | 10/1980 | Austin | 229/114 |
| 4,232,816 | 11/1980 | Johnson et al. | 229/114 |
| 4,245,773 | 1/1981 | Stollberg | 229/DIG. 11 |
| 4,254,862 | 3/1981 | Barratt | 206/63.3 |
| 4,266,713 | 5/1981 | Maroszek | 229/146 |
| 4,304,353 | 12/1981 | Stollberg | 229/DIG. 11 |
| 4,360,147 | 11/1982 | Brauner | 229/148 |
| 4,389,013 | 6/1983 | Hall et al. | 206/509 |
| 4,413,726 | 11/1983 | Davidson | 206/45.13 |
| 4,431,128 | 2/1984 | Dirico . | |
| 4,570,845 | 2/1986 | Hall . | |
| 4,792,085 | 12/1988 | Waring, III et al. | 229/114 |
| 4,877,178 | 10/1989 | Eisman | 229/114 |
| 4,909,432 | 3/1990 | Nagata | 229/137 |
| 5,039,003 | 8/1991 | Gordon et al. | 229/114 |
| 5,098,013 | 3/1992 | France et al. | 229/115 |

*Primary Examiner*—Gary E. Elkins
*Attorney, Agent, or Firm*—Willian Brinks Olds Hofer Gilson & Lione

[57] ABSTRACT

A clamshell type carton is provided with a cut along the hinge score line connecting the upper cover and lower tray portions. Either a second cut in the back panel of the carton, above or below the hinge score line cut, or a cut-out slot encompassing the hinge score line cut, is utilized to facilitate the easy opening and closing of the carton without buckling occurring in the back panel in the region of the hinge score line.

30 Claims, 2 Drawing Sheets

Fig. 1
Prior Art
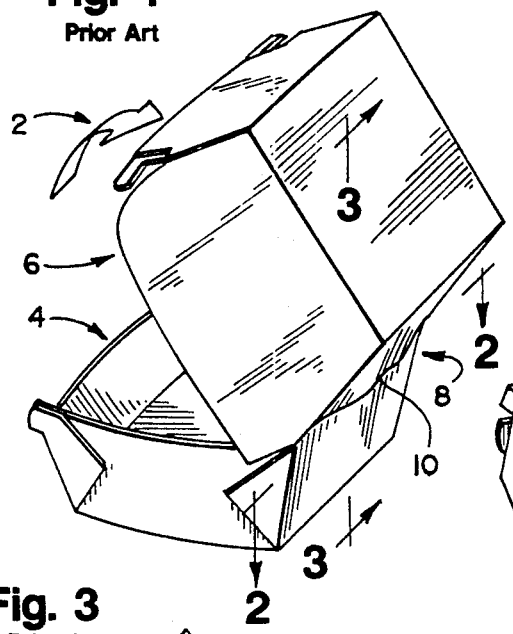
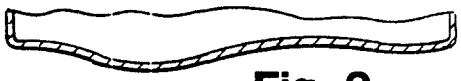
Fig. 2
Prior Art
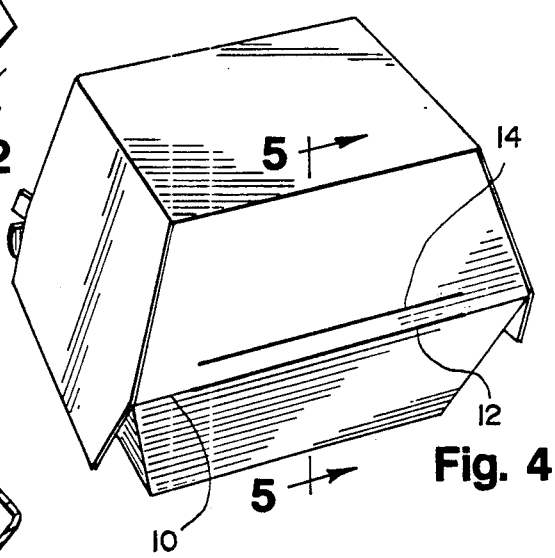
Fig. 4
Fig. 3
Prior Art
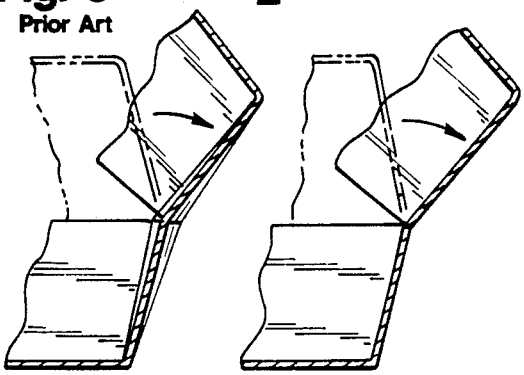
Fig. 5
Fig. 6
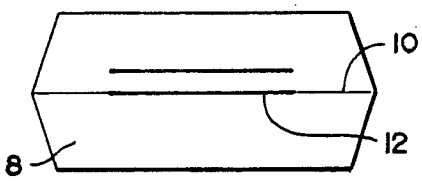
Fig. 7
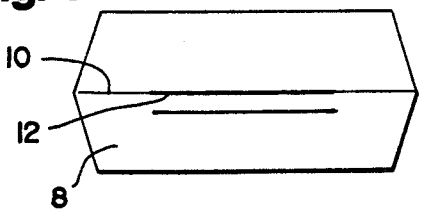
Fig. 8
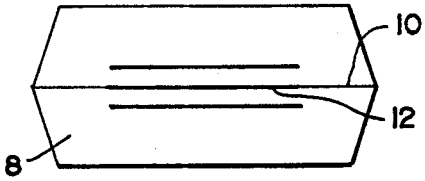
Fig. 9
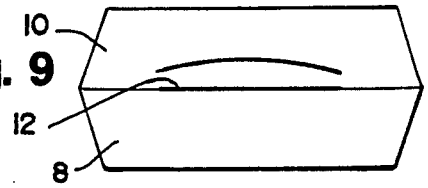
Fig. 10
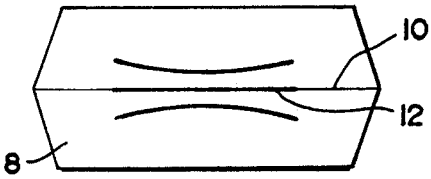

Fig. 11
Prior Art
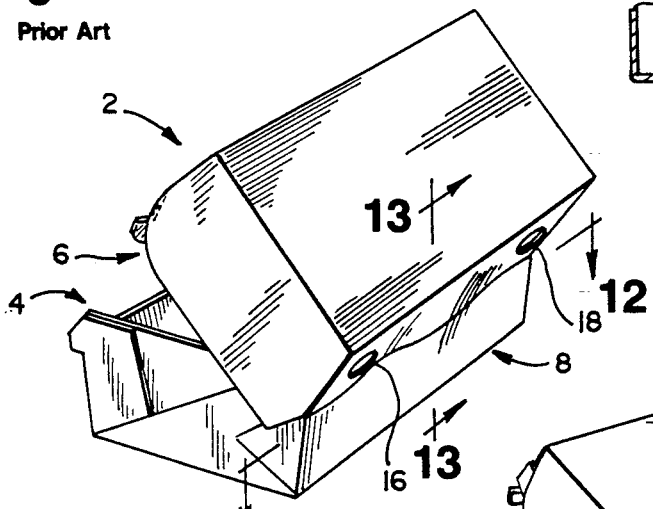
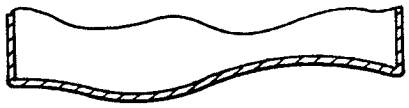
Fig. 12
Prior Art
Fig. 14
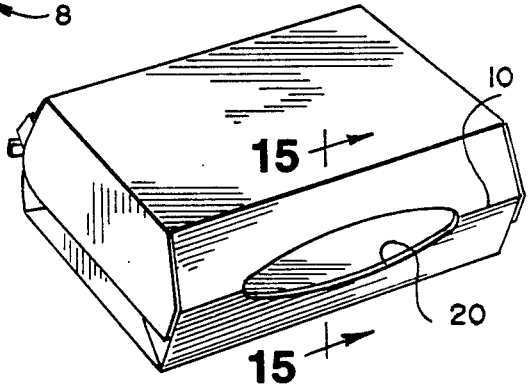
Fig. 13
Prior Art
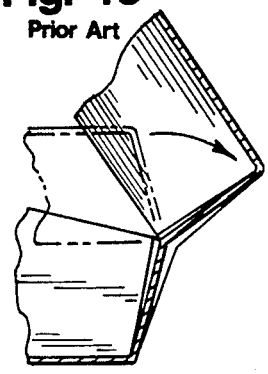
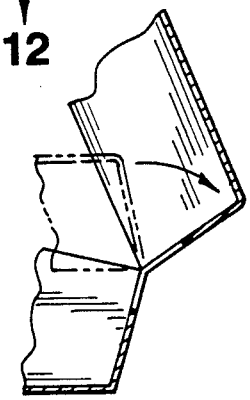
Fig. 15
Fig. 16
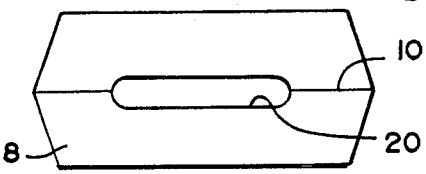
Fig. 17
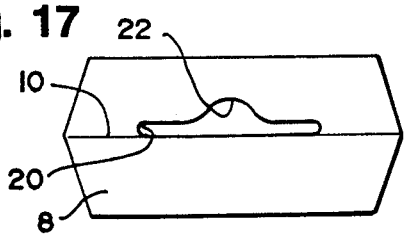
Fig. 18
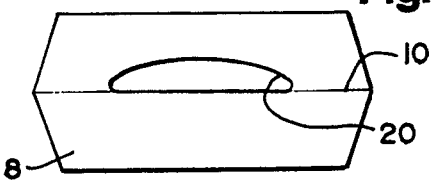
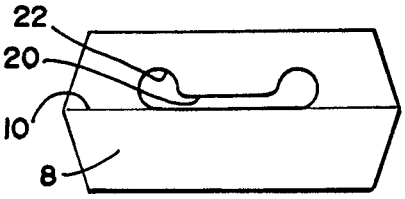
Fig. 19
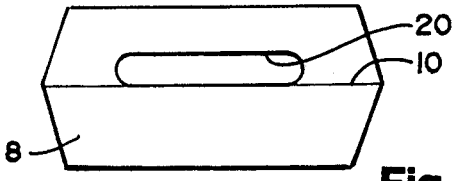
Fig. 20

BUCKLE-PROOF CLAMSHELL CARTON

FIELD OF THE INVENTION

This invention generally relates to double cavity "clamshell" containers such as those used in the packaging of hamburgers and other food products. More specifically, the invention concerns clamshell cartons fabricated from folded paperboard, boxboard or corrugated board, and addresses the problem of buckling which occurs in the center back region of such cartons upon opening and closing.

BACKGROUND OF THE INVENTION

In fast service and carry-out food businesses, it is necessary to package food products in containers which are inexpensive, easy to ship and store, and convenient to use for the retailer and the consumer. When assembled and filled with food products, such containers must be easy to close and open, and yet they must remain shut in transport from the food counter to a table or other carry out location. It is also important, in the design and construction of such containers, to take into account environmental aspects of their use.

One form of packaging which has addressed these concerns, and has met with acceptance, is a carton comprised of a joined tray and cover with integral latching means which can be readily formed from a cut and scored blank. The cut and scored blank is made from paperboard, boxboard or corrugated board. When partially folded and glued, the blank forms a hingedly connected tray and cover, each in the form of a truncated pyramid. Such partially folded cartons can be shipped and stored in nested condition. In use, various food products, such as hamburgers, chicken pieces, pizza slices and the like, are placed in the tray portion of the partially folded carton, and the cover portion is folded over the tray portion and latched thereto at a location opposite the fold or hinge in the back panel of the carton. Such double cavity, folded tray and cover, cartons are referred to a clamshell cartons. A clamshell carton is disclosed, for example, in U.S. Pat. No. 4,877,178, issued Oct. 31, 1989 to Dopaco, Inc. as assignee.

One problem which has been encountered with such clamshell cartons, particularly when they are made from thinner grades of paperboard, has been their tendency to buckle in the back as they are being closed by restaurant crew persons or opened by customers. For example, when the top cover portion is lifted and folded back on the center hinge in the rear portion of the carton, the region adjacent the hinge tends to flex and bow. This problem is sometimes referred to as "oil canning" because the back region of the carton can distort as opening begins and then pop back into its proper and intended configuration, in much the same way as an oil can lid pops back into position after being depressed. The buckling problem appears to be caused by the flexible nature of the carton material, the spacing between the front of the carton and the back region where the buckling occurs and the forces applied to the carton portions as they are handled during the closing and opening operations. This problem is a troublesome and awkward one for crew persons trying to rapidly assemble and fill nested and partially folded blanks, and for consumers trying to open the carton and access its contents. Sometimes, a consumer can alleviate the problem during opening by pressing his fingers in the buckled region to realign the carton portions. In other instances, however, trying to fully open the cover and forcibly overcome the buckling can result in a torn container and/or spilled contents.

The prior art has addressed this buckling problem. U.S. Pat. No. 4,232,816 discloses the use of one or more slits which are normal to, and bisect, the fold line in the rear wall of a clamshell container. Such slits are said to weaken the center portion of the rear wall and thereby reduce the tendency of that wall to buckle upon opening. U.S. Pat. No. 4,266,713 discloses the provision of lines of weakness so positioned relative to the center hinge as to create a separate hinge ridge or an inverted hinge channel upon closing the carton. Such a hinge ridge or hinge channel is said to stabilize the rear carton wall against buckling and/or bowing outwardly. U.S. Pat. No. 4,792,085 discloses various diagonal, intersecting incisions above and below the hinge line of a clamshell container, as well as ribs formed above, below and parallel to the hinge line.

These efforts of the prior art, while directed at the buckling problem associated with clamshell cartons, have not been widely accepted; and have been found to be less than entirely satisfactory.

Accordingly, it is a primary object of this invention to provide a novel clamshell carton construction which can be easily made and conveniently closed or opened without encountering undesirable buckling or "oil canning" effects.

SUMMARY OF THE INVENTION

The above and other objects are realized in the clamshell carton of the present invention, wherein a knife cut is made along the hinge line or hinge score of the blank used to fabricate the clamshell carton. At the same time, a second knife cut is made adjacent the first knife cut, or a slot encompassing the first knife cut is formed, in the back panel of the carton. The second knife cut and/or the slot, working in conjunction with the first knife cut along the hinge line have proven to virtually eliminate the aforediscussed buckling problem found in prior art clamshell containers.

In certain food packaging applications, a vented carton is neither necessary nor desirable. For example, in a hamburger box, it is desirable that heat be retained and that there be no openings in the carton, particularly in the lower tray portion, for hamburger dressings to leak out during transport. In a preferred embodiment of the invention, intended for use in such applications, a first thin knife cut is made along a portion of the back panel hinge score line and a second thin knife cut is made in the back panel of the carton above the hinge score line. It has been found that the buckling problem is best addressed when the two cuts are adjacent, generally coextensive, generally parallel and centered with respect to a vertical plane bisecting the carton back panel. Excellent results have been achieved in such a hamburger box configuration where the two cuts are spaced apart approximately ¼-inch and are approximately half the length of the entire hinge score.

As long as one knife cut lies along the hinge score line, the placement and shape of the second knife cut is not critical, and there can be many alternative arrangements within the scope of the present invention. For example, the second cut can be curved or zigzagged. The second cut can be entirely parallel to the first, or partially parallel. The second cut can be spaced at varying distances from the cut along the hinge line. The first and second cuts can have differing lengths and differing thicknesses. Combinations of such features may likewise be employed within the teachings and scope of the present invention.

There are other food packaging applications where venting is desirable and/or required. For example, recently fried foods such as fried chicken pieces are often packaged while still very hot. In such instances, it may be desirable that the carton be vented so as to permit the contents to cool slightly before consumption. The present invention encompasses a buckle-proof carton made for such applications. In a preferred embodiment, the first knife cut along the back panel hinge score line forms part of the periphery of a horizontal slot or cutout. Although not necessary for the present invention, it is preferable that the slot be disposed above the hinge score so that food products resting in the tray portion of the carton can not fall out of the carton in normal use. The size of the slot can be varied depending on the size of the carton, the size of the food pieces in the carton and the amount of venting desired. Also, the slot can be variously shaped. For ease of manufacturing, and depending on the size of the slot, it may be desirable that the slot have one or more enlarged portions to facilitate the stripping out of paper material during the manufacture of the blank from which the clamshell carton is made. The principal requirement is that the slot must break or interrupt the score line running across the back panel of the carton.

In accordance with the present invention, a stress relief region is created by the adjacent knife cuts or the slot which virtually eliminates oil canning. The full nature of the invention will be understood from the accompanying drawings and the following description and claims.

BRIEF DESCRIPTION OF THE DRAWINGS

FIG. 1 is a perspective view of a prior art clamshell type carton, and shows buckling in the back panel upon opening.

FIG. 2 is a cross-sectional view taken along line 2—2 of FIG. 1.

FIG. 3 is a cross-sectional view taken along line 3—3 of FIG. 1

FIG. 4 is a perspective view of an improved clamshell type carton, made according to the present invention, and featuring parallel knife cuts in the back panel, one on the hinge score line.

FIG. 5 is a cross-sectional view taken along line 5—5 of FIG. 4.

FIG. 6 is a rear elevation view of the improved clamshell type carton shown in FIG. 4.

FIGS. 7–10 are views of the back panel of the improved clamshell type carton, made according to the present invention, showing other arrangements of cuts which contribute to buckle free opening.

FIG. 11 is a perspective view of a vented prior art clamshell type carton, and shows buckling in the back panel upon opening.

FIG. 12 is a cross-sectional view taken along line 12—12 of FIG. 11.

FIG. 13 is a cross-sectional view taken along line 13—13 of FIG. 11.

FIG. 14 is a perspective view of an improved, vented clamshell type carton, made according to the present invention, and featuring a slot cut out of the back panel and interrupting the hinge score line.

FIG. 15 is a cross-sectional view taken along line 15—15 of FIG. 14.

FIGS. 16–20 are views of the back panel of the improved, vented clamshell type carton, made according to the present invention, showing other slot configurations which contribute to buckle free opening and closing.

DETAILED DESCRIPTION OF THE PREFERRED EMBODIMENT

Reference is made to FIG. 1 for the general details of a typical prior art clamshell type carton used for sandwiches and the like. There is shown a carton which is assembled from a unitary cut and scored blank. In its assembled form, the carton 2 has a hingedly connected tray 4 and cover 6, each in the form of a truncated pyramid, joined by an integral back panel 8. In use, food product is placed in tray 4 and the cover 6 is folded over the tray 6 and latched thereto at the forward end of the carton. FIG. 1 also shows the hinged connection of the tray 4 and cover 6 defined by the scored hinge line 10 extending horizontally across the center of back panel 8. The scored hinge line 10 may be formed by a crease, a perforation or a combination thereof; however, it must be sufficiently strong so as to permit repeated opening and closing and to maintain the structural integrity of the container.

The particular latching mechanism illustrated in FIG. 1 is not a part of the present invention or the prior art; rather, such latching mechanism is disclosed and claimed in commonly owned and pending U.S. application Ser. No. 07/898,027, filed Jun. 12, 1992, the disclosure of which is incorporated herein by reference.

As will be seen in FIGS. 1–3, the prior art clamshell type carton of FIG. 1 is prone to buckling in the back panel 8 when the cover 6 is lifted and folded back on the center hinge in the back panel 8. It should be noted that the buckling problem is an equally troublesome one during the carton closing operation.

FIG. 4 shows an improved clamshell type carton according to the present invention. The parts of the illustrated carton perform similar functions to the parts shown in the carton of FIG. 1, and are identified with like numbers. Unlike the prior art, however, the improved clamshell container of the present invention has a cut 12 along a portion of the scored hinge line 10 and an adjacent cut 14 in the back panel 8 above cut 12. In practice, it has been found advantageous to place the cut 12 generally in the vicinity of the midpoint of hinge line 10 as it runs from one side of the container 2 to the other. Such placement enables the use of a cut 12 which is as long as possible without severing or destroying the integrity of hinge line 10. Generally, it has been found suitable to make cut 12 a length equal to approximately half the length of the hinge line 10. As illustrated in FIG. 4, cut 14 is parallel to and coextensive with cut 12. Also, they are adjacent, meaning that they may be closely spaced apart from each other. It has been found expeditious to space cuts 12 and 14 approximately ¼-inch apart.

Alternative versions of cooperating cuts are shown in FIGS. 6–10. FIG. 6 and FIGS. 7 10 show t he use of cartons having perforated hinge lines. FIG. 7 further shows placement of the second cut at a location on back panel 8 which is below hinge line 10. FIG. 8 shows that cuts can be made above and below the hinge line, so long as there exists a cut along the hinge line. FIGS. 9–10 show that the cut or cuts corresponding to the hinge line cut may be curved. Furthermore, it is within the teachings and scope of this invention that the respective cuts can be of different lengths, sizes and shapes so long as at least one knife cut lies along the hinge score line.

FIGS. 11–13 are illustrative of prior art clamshell type containers used in applications where it is desirable to provide an opening in the container to vent the contents. Thus, FIG. 11 shows a carton construction similar to that shown in FIG. 1, but more rectangular and having vent holes 16 and 18 in the back panel. Prior art vented cartons such as the one shown in FIGS. 11–13 experience the same buckling or oil canning phenomenon in use.

FIG. 14 shows a buckle-proof clamshell type carton made, according to the present invention, for applications where venting of the carton contents is desirable or required. A generally elliptical, horizontal slot 20 is cut out of back panel 8 at a location which interrupts hinge line 10. As shown in FIGS. 16–20, the slot 20 can be cut to a number of different shapes and sizes. However, the slot must always break or interrupt the hinge line 10 on the back panel 8. Depending on the size of the slot, and the equipment used to strip excess paper material away from the cut and scored blank used to make the carton, it may be necessary to configure the slot with a protuberance or enlargement that the stripper barbs can engage during a stripping operation. One or more such enlarged portions 22 may be employed, as shown in FIGS. 17 and 19.

Although the invention has been described above by reference to preferred embodiments thereof, it will be appreciated that the foregoing and other changes may be made without departing from the scope and spirit of the invention as defined by the claims appended hereto.

I claim:

1. In a clamshell type container having a top cover portion, a bottom tray portion and an integral back panel, wherein said cover portion and said tray portion are hingedly connected through a hinge line extending across said back panel, the improvement comprising:

a first cut along said hinge line, said cut being continuous and approximately half the length of said hinge line; and a second cut in said back panel above said first cut.

2. A container according to claim 1, wherein said first cut is centrally disposed along said hinge line.

3. A container according to claim 1, wherein said second cut is curved.

4. A container according to claim 1, wherein said first and second cuts are generally coextensive with each other.

5. A container according to claim 1, wherein said first and second cuts are approximately ¼-inch apart.

6. In a clamshell type container having a top cover portion, a bottom tray portion and an integral back panel, wherein said cover portion and said tray portion are hingedly connected through a hinge line extending across said back panel, the improvement comprising:

a cut along said hinge line; and at least one cut in said back panel generally coextensive with said hinge line cut.

7. A container according to claim 6, wherein said hinge line cut is approximately half the length of said hinge line.

8. A container according to claim 6, wherein said hinge line cut is centrally disposed along said hinge line,

9. A container according to claim 6, wherein said generally coextensive back panel cut is adjacent said hinge line cut.

10. A container according to claim 6, wherein said generally coextensive back panel cut is generally parallel to said hinge line cut.

11. A container according to claim 6, wherein both said hinge line cut and said back panel cut are centrally disposed across said back panel.

12. A container according to claim 6, wherein said hinge line cut and said back panel cut are approximately ¼-inch apart.

13. A container according to claim 6, wherein said generally coextensive back panel cut is curved.

14. In a clamshell container having a top cover portion, a bottom tray portion and an integral back panel, wherein said cover portion and said tray portion are hingedly connected through a hinge line extending across said back panel, the improvement comprising:

a first cut along said hinge line, said hinge line cut centrally disposed along said hinge line and having a length equal to approximately half the length of said hinge line; and a second cut in said back panel adjacent said hinge line cut; said second cut being generally coextensive with and generally parallel to said first cut;

whereby buckling of said back panel is avoided when said cover portion is folded about said back panel hinge line.

15. A container according to claim 14, wherein said generally coextensive and generally parallel cut is above said hinge line.

16. A container according to claim 14, wherein either of said cuts is sufficiently wide to permit venting of the container.

17. In a clamshell type container formed from a paperboard blank and having a top cover portion, a bottom tray portion and an integral back panel, wherein said cover portion and said tray portion are hingedly connected through a hinge line extending across said back panel, the improvement comprising a single slot cut out of said back panel and interrupting said hinge line, said single slot encompassing approximately half the length of said hinge length.

18. A container according to claim 17, wherein a portion of said slot is defined by a cut along said hinge line.

19. A container according to claim 17, wherein said slot is generally elliptical.

20. A container according to claim 17, wherein said slot includes at least one enlarged region to facilitate stripping out of paper material during fabrication.

21. A container according to claim 17, wherein said slot is centrally disposed along the length of said hinge line.

22. A container according to claim 17, wherein said slot includes at least one straight edge defined by a straight cut along said hinge line.

23. A container according to claim 22, wherein said slot includes a curved portion adjacent said hinge line cut.

24. A container according to claim 17, wherein said slot has a minimum width at any point along its length of approximately ⅛-inch.

25. In a clamshell container having a top cover portion, a bottom tray portion and an integral back panel, wherein said cover portion and said tray portion are hingedly connected through a hinge line extending across said back panel, the improvement comprising a slot cut out of said back panel and horizontally disposed with respect thereto, said slot defined in part by a cut coincident with said hinge line and extending approximately half the length of said hinge line; whereby buckling of said back panel is avoided when said cover portion is folded about said back panel hinge line.

26. A container according to claim 25, wherein said hinge line cut defines a lowermost portion of said slot.

27. A container according to claim 25, wherein at least one portion of said slot is curved.

28. A container according to claim 25, wherein said slot is generally elliptical.

29. A container according to claim 25, wherein said slot includes at least one enlarged region to facilitate stripping out of paper material during fabrication.

30. A container according to claim 25, wherein said slot is centrally disposed along the length of said hinge line.

* * * * *

UNITED STATES PATENT AND TRADEMARK OFFICE

CERTIFICATE OF CORRECTION

PATENT NO. : 5,221,040
DATED : June 22, 1993
INVENTOR(S) : John F. Sorenson

It is certified that error appears in the above-indentified patent and that said Letters Patent is hereby corrected as shown below:

Column 1, line 41, delete "a" and substitute therefor --as--.

Column 4, line 62, insert "-" between "7 10".

Column 5, Claim 8, line 2, after "line", delete "," and substitute therefor ----.--.

Signed and Sealed this

Twenty-sixth Day of April, 1994

*Attest:*

*Attesting Officer*

BRUCE LEHMAN

*Commissioner of Patents and Trademarks*